United States Patent [19]

Hesse et al.

[11] 4,228,487

[45] Oct. 14, 1980

[54] COMPOSITE LAMP ASSEMBLY WITH DETACHABLE CLAMPING MEANS

[75] Inventors: Kurt Hesse, Lemgo; Hartmut S. Engel, Ludwigsburg, both of Fed. Rep. of Germany

[73] Assignee: Staff KG, Lemgo, Fed. Rep. of Germany

[21] Appl. No.: 913,421

[22] Filed: Jun. 7, 1978

[30] Foreign Application Priority Data

Jun. 8, 1977 [DE] Fed. Rep. of Germany ... 7718119[U]

[51] Int. Cl.[2] ..... H01F 23/68

[52] U.S. Cl. ..... 362/240; 362/277; 362/363; 362/368; 362/413; 362/430; 362/431

[58] Field of Search ..... 362/31, 127, 140–144, 362/238, 240, 277, 363, 367, 368, 372, 401, 410, 413, 414, 429, 430, 431

[56] References Cited

U.S. PATENT DOCUMENTS

| | | | |
|---|---|---|---|
| 1,861,604 | 6/1932 | Loring | 362/801 X |
| 2,519,690 | 8/1950 | Recktenwald | 362/32 |
| 2,608,367 | 8/1952 | Boltuch | 362/413 X |
| 2,636,112 | 4/1953 | Dvorsky | 362/413 |
| 3,122,383 | 2/1964 | Hirsch . | |
| 3,182,186 | 4/1965 | Faulk | 362/238 |
| 3,465,139 | 9/1969 | Siegal | 362/32 |
| 3,806,399 | 4/1974 | Cocjin | 362/414 X |
| 3,959,645 | 5/1976 | Patry | 362/431 |
| 3,979,584 | 9/1976 | Fossati | 362/806 X |
| 3,985,924 | 10/1976 | Pritza | 362/431 X |
| 4,127,892 | 11/1978 | Bakalowits et al. | 362/806 X |

FOREIGN PATENT DOCUMENTS

| | | | |
|---|---|---|---|
| 294974 | 12/1971 | Austria . | |
| 7618061 | 5/1976 | Fed. Rep. of Germany . | |
| 26294 | 4/1922 | France | 362/252 |
| 1473759 | 4/1966 | France . | |

*Primary Examiner*—Peter A. Nelson

*Attorney, Agent, or Firm*—Pollock, Vande Sande & Priddy

[57] ABSTRACT

A composite lamp assembly, especially for outdoor use, including a plurality of lighting fixtures individually supported by composite arms extending at angles other than 90 degrees from a central mast, with a novel ring-shaped clamping assembly detachably joining adjacent connecting sections to form the arms, and the clamping assembly including aligning surfaces ensuring proper rotational positioning of adjacent connecting sections.

18 Claims, 6 Drawing Figures

8
5
2b
4
3
6
2
7
2a
1

COMPOSITE LAMP ASSEMBLY WITH DETACHABLE CLAMPING MEANS

BACKGROUND OF THE INVENTION

The present invention relates to a novel composite lamp including a clamping assembly for detachably joining adjacently positioned connecting sections.

Large composite lamps, of the type intended for use outdoors, generally include a plurality of permanently fastened connecting sections which provide rigid support for a plurality of individually mounted lighting fixtures. Known lamp assemblies may include connecting sections fastened together by welding or with the aid of lever rods and bendable sheet metal edges.

A basic problem facing these known composite lamps is the inability to maintain circumferential alignment between adjacent connecting sections during the fastening process, which limits the lamp assembly to a vertically extending mast engaging a plurality of horizontally extending composite support arms. Because of the difficult alignment problem, known lamp assemblies avoid the use of angled connections even though they are desirable in terms of esthetics. Furthermore, the heavy weight of large outdoor composite lamps requires that fastening connections be achieved with no room for error. This poses a problem for the non-skilled mechanic, in that a relatively high degree of skill is required to properly weld adjacent sections or to correctly tension the lever rod assembly. If the lamp sections are improperly joined, premature failure of the connection may result, which can easily lead to human injuries.

As will be discussed in detail therafter, applicant's new and useful invention solves the problems confronting the prior art, while at the same time providing an inexpensive clamping assembly for detachably joining adjacent connecting sections in a manner to withstand high and prolonged stresses which may effect the lamp.

OBJECTS AND SUMMARY OF THE PRESENT INVENTION

An object of the present invention is to provide a composite lamp assembly, wherein separate connecting sections are detachably fastened end-to-end via a novel clamping assembly according to the present invention.

A further object of the present invention is to provide a composite lamp assembly, wherein separate connecting sections are circumferentially alignable relative to one another by attachment with the novel clamping assembly.

An object of the present invention is to provide a composite lamp assembly, wherein the fastened connecting sections appear as an integral support arm which may be attached at angles other than 90 degrees to a centrally extending mast.

Another object of the present invention is to provide a novel clamping assembly for a composite lamp, wherein the clamping assembly is adjustable to provide a variable clamping pressure as desired.

An object of the present invention is to provide a composite lamp structure which is inespensive to manufacture and easy to assembly by a non-skilled mechanic.

The above-stated objects are achieved by a preferred embodiment of the present invention, wherein a ring-shaped clamping assembly is positioned to clamp end surfaces of adjacent connecting sections. Radially, inwardly extending flanges formed on the end portions of the connecting sections are brought into abutting contact, following which the ring-shaped clamping unit surrounding the flanges cooperates with a pair of talon-shaped wedging members positioned inside the flanged end surfaces.

Tensioning screws extend from the ring unit into each of the talons, with the screws being inwardly rotated to bring the ring unit and talons into clamping abutment against the flanged end surfaces. The degree of tension can be adjusted for the size of the particular composite lamp or chandelier. The outer surface of the ring makes flush contact with outer surfaces of the adjacent connecting sections, with the screws having recessed, hexagonally-shaped heads not extending beyond the outer surface of the ring unit.

The ring unit is formed with at least one flat surface portion corresponding to similar, flat surface portions formed on both of the connecting sections, to circumferentially align the sections. Conveniently, four flat surface portions spaced 90 degrees apart may be formed in the surface of the ring unit corresponding with similarly-shaped, flat surface portions spaced about the surfaces of the connecting sections. This allows for fastening by the ring unit when the connecting sections are rotated up to 90 degrees. Finally, the ring unit may be formed with internal ribs which guide the talon-shaped wedging members while offering resistance to the tightening thereof. The rids prevent undesirable rotation of the talons during rotation of the tensioning screws.

A complete understanding of the present invention will become apparent from a reading of the following specification and claims, together with the accompanying drawings, wherein similar elements are referred to and are indicated by similar reference numerals.

BRIEF DESCRIPTION OF THE DRAWINGS

The present invention can be best understood with reference to the accompanying drawings, wherein.

DETAILED DESCRIPTION OF A PREFERRED EMBODIMENT

Figure 1:
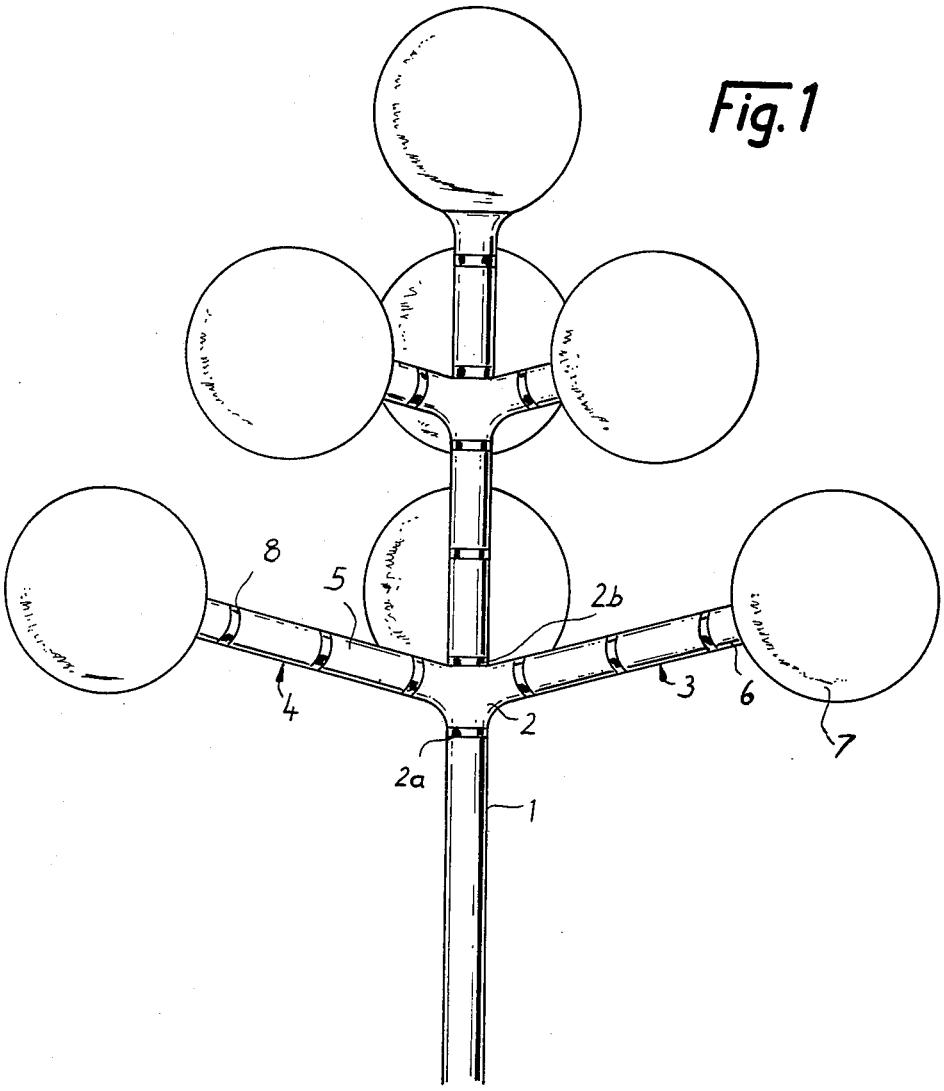
FIG. 1 shows a partial side view of an assembly composite lamp according to the present invention which may be used to provide an esthetic outdoor source of light.
Figure 2:
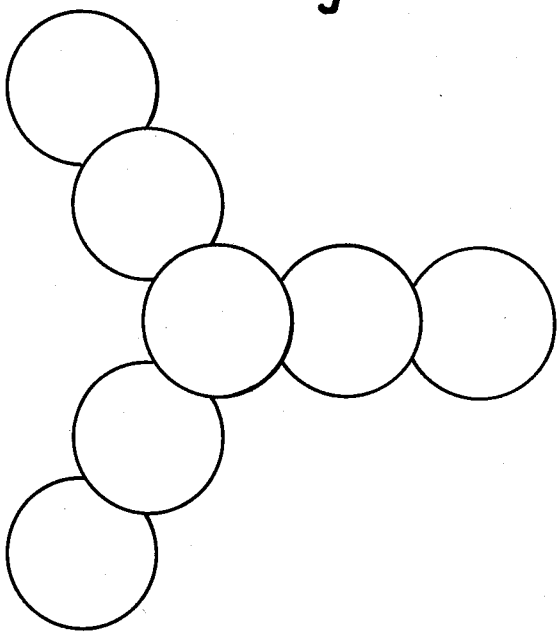
FIG. 2 shows a schematic cutout of the arrangement of lighting fixtures according to the lamp of FIG. 1.
Figure 3:
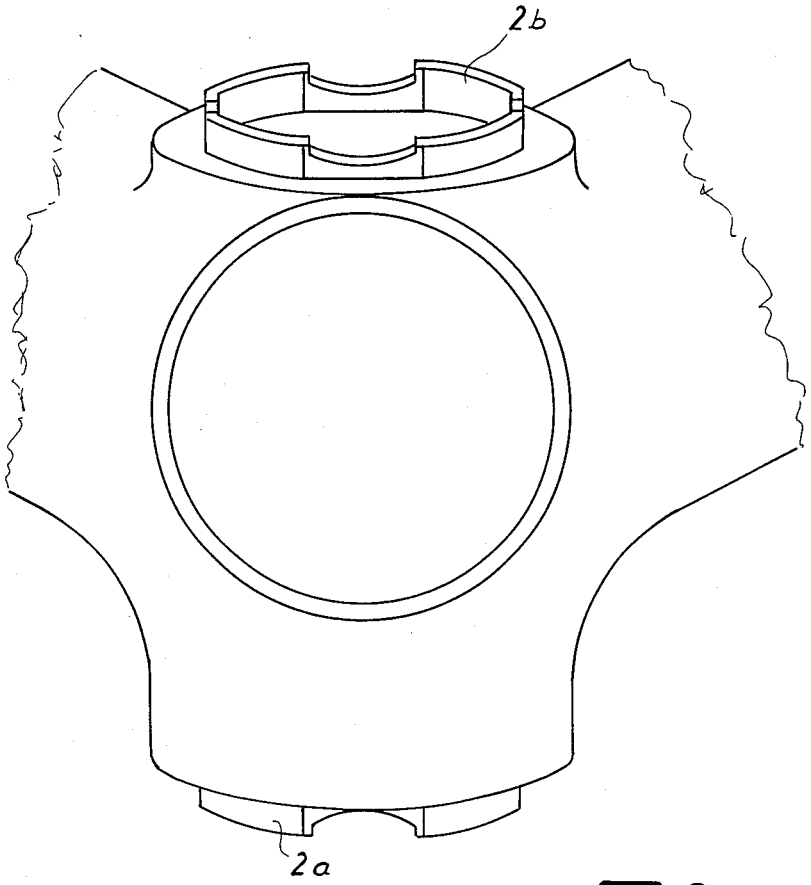
FIG. 3 shows a partial aspect of a joining point or nodal unit of the lamp according to FIG. 1.

Referring to the drawings, and FIG. 1 in particular, a side view of a preferred embodiment of the composite lamp is shown. The lamp comprises a mast 1 having an end attached to nodal unit 2, better shown in FIG. 3.

Nodal unit 2 may include a lower exit **2*a* attached to mast 1, an upper exit 2*b* attached to a further mast section and three obliquely angled exits attached to fixture support arms, of which only arms 3 and 4 are shown in FIG. 1. While the particular shape of nodal unit 2 indicated in FIG. 1 comprises a preferred embodiment, it is considered to be within the scope of the present invention to mount any number of exits on nodal unit 2** and to point the exits in any desired direction so as to create an esthetically pleasing composite lamp assembly.

Arms 3 and 4 as well as mast 1 may be formed from a plurality of cylindrically-shaped, hollow connection sections 5 similar to one another. Connecting sections 5 include radially, inwardly extending flanged end portions 11 which are fastened within a novel, ring-shaped clamping assembly 8. An end of each of the arms 3 and 4 may be fastened to an exit of nodal unit 2 via a further ring unit 8. A further end of each of the arms 3 and 4 is similarly fastened to a fixture housing 6 which supports a spherical globe 7.

It would, of course, be within the scope of protection to modify the preferred embodiment by substituting a fixture of any desired geometrical shape for globe 7.

Figure 4:
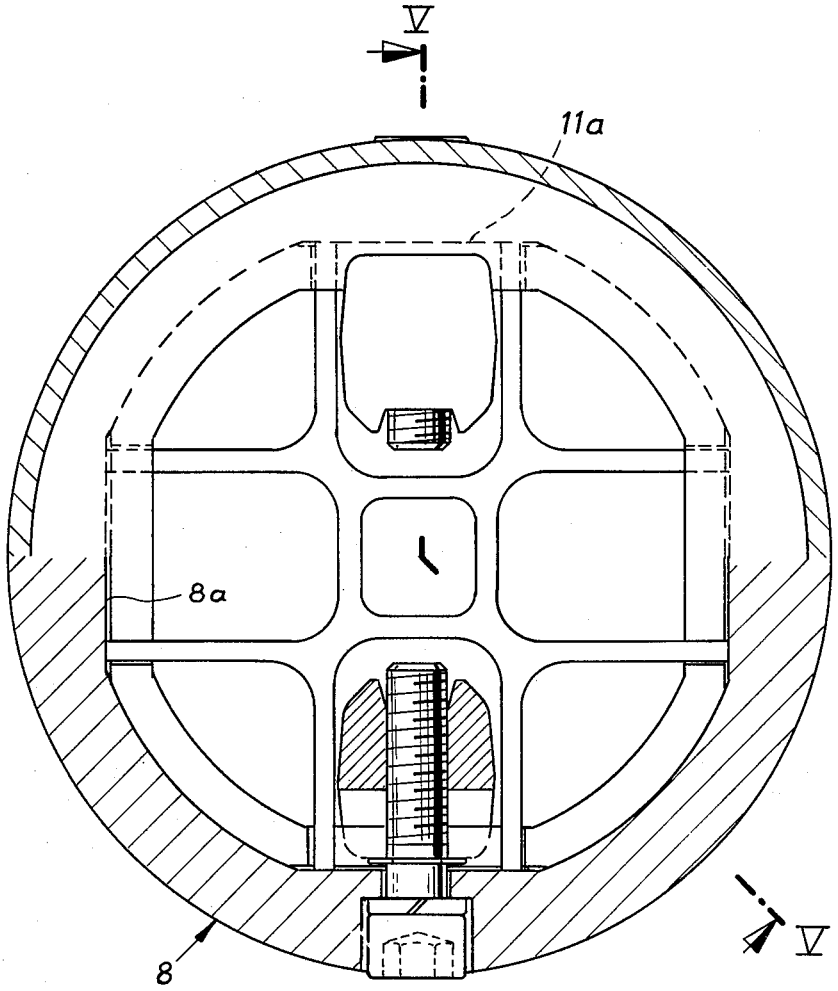
FIG. 4 shows a horizontal section through a connection point between adjacent connecting sections along a line IV—IV of FIG. 5.
Figure 5:
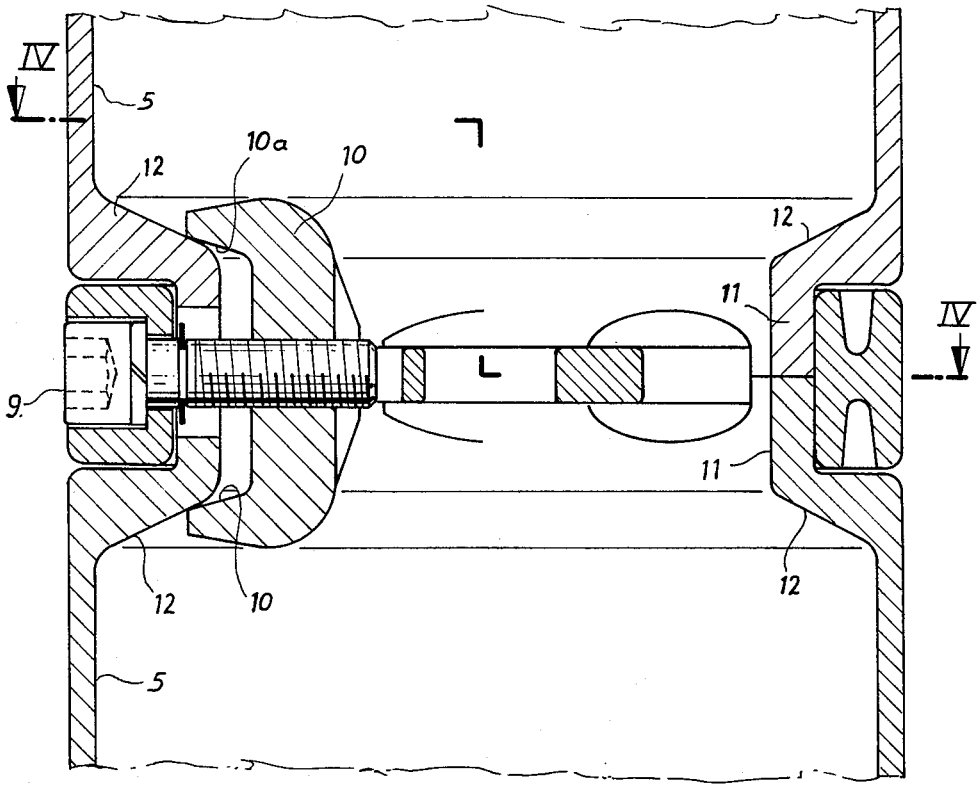
FIG. 5 shows a vertical, longitudinal section through the connection point of FIG. 4 along a line V—V.
Figure 6:
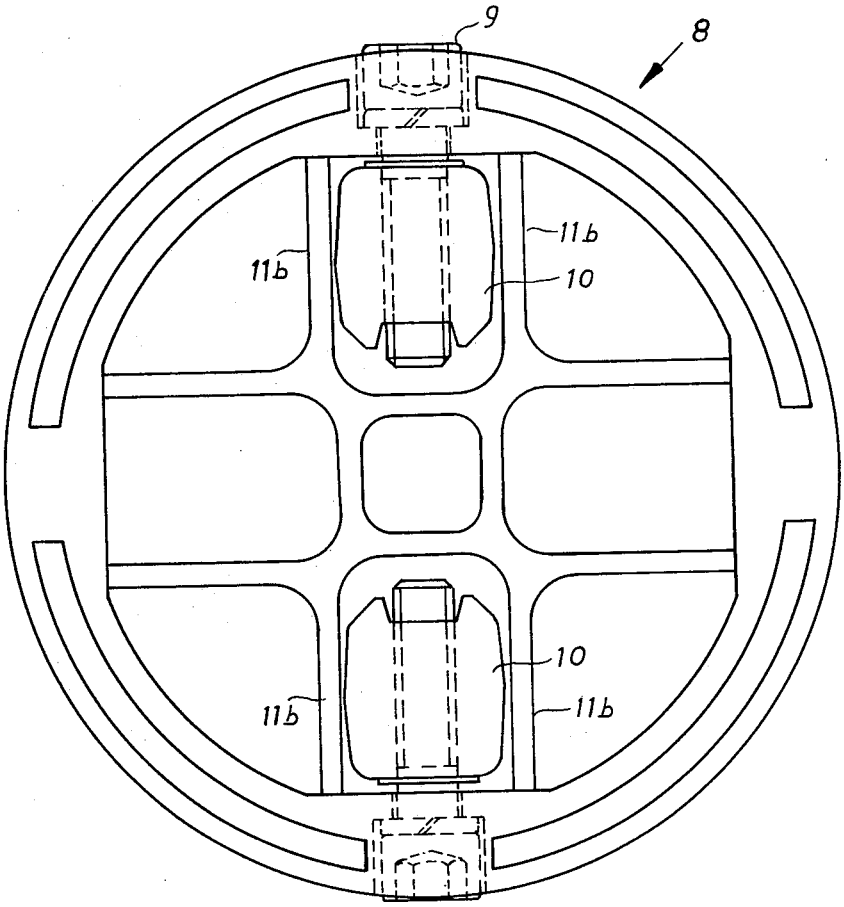
FIG. 6 shows a top view of the ring-shaped clamping unit according to a preferred embodiment of the present invention.

A detailed explanation of ring-shaped clamping assembly 8 follows, with reference to FIGS. 4–6, respectively. FIG. 6 shows a top view of ring unit 8, wherein a pair of diametrically opposed tension screws 9 extend inwardly through ring unit 8 into a pair of diametrically opposed talon-shaped wedging members 10. FIG. 5 discloses the shape and position of talons 10 when contacting the flanged end surfaces 11 of adjacent connecting sections 5.

Talons 10 are secured against rotation by laterally extending guide ribs **11*b*, see FIG. 6, which form an internally extending grid within ring unit 8. As hexagonal tension screws 9 are rotated into ring unit 8, inclined lobe portions 10*a* formed on talons 10 are brought into abutting contact with inclined shoulders 12 which lead to flanged end portions 11. The result is to fixedly clamp adjacent, flanged end portions 11 between ring unit 8 and talons 10. It is noted that lobe portions 10*a* are formed with a steeper degree of incline than shoulders 12 to ensure a constant pressure therebetween during engagement of ring unit 8**.

Circumferentially extending, flanged end portions 11 are formed with four flat surfaces **11*a* which may conveniently be positioned 90 degrees apart as shown in FIG. 4. Corresponding flat portions 8*a* are formed on a circumferential surface of ring unit 8, with the portions 8*a* also being conveniently positioned 90 degrees apart. When connecting sections 5 are positioned adjacent one another, the flat portions 11*a* of both sections 5 must align with flat portions 8*a* before ring unit 8 can be fastened. This ensures that the sections 5 are properly aligned and fastened in proper rotational position with respect to each other. Cooperating flat surfaces 11*a* and 8*a* permit assembly of globes 7** in specific positions, thereby providing an esthetically satisfying assembly.

It would be within the scope of protection to form connecting sections 5 and ring unit 8 with any number of spaced, flat surfaces. As fewer flat portions are formed on the members, the number of circumferential alignment positions for adjacent connecting sections 5 would correspondingly decrease.

The present invention is not limited to the above-described preferred embodiment or stated modifications, but is to be limited only by the scope of the following claims.

What is claimed is:

1. A composite lamp assembly providing artificial illumination, and comprising:

a central mast having at least one composite arm extending from said mast, with said composite arm supporting at least one light fixture attached thereto;

said composite arm comprising a plurality of substantially similarly-shaped connecting sections having end portions adjacently positioned to one another, wherein each end portion is substantially circumferential cross-sectional configuration with inner and outer surfaces facing in opposite radial directions from one another;

detachable clamping means for joining said adjacently positioned end portions to form said composite arm;

wherein said detachable clamping means comprises a substantially ring-shaped clamping unit circumferentially overlapping radially outer surfaces of said adjacently positioned end portions, at least one wedging member engaging radially inner surfaces of said adjacently positioned end portions, and a tensioning screw extending between and threadedly engaging said clamping ring and said wedging member, whereby selective rotation of said tensioning screw operates to draw said clamping unit and said wedging member toward one another and into clamping engagement with adjacently positioned end surfaces.

2. A composite lamp assembly according to claim 1, wherein said central mast assembly comprises a substantially cylindrically-shaped, hollow-member fixedly attached to a support assembly.

3. A composite lamp assembly according to claim 1, wherein a plurality of said composite arms each extends in a non-perpendicular direction from said central mast assembly.

4. A composite lamp assembly according to claim 3, wherein at least one attachment including a plurality of spaced terminals is fastened to said central mast assembly, with a separate composite arm engaging and extending from each separate terminal formed in said attachment assembly.

5. A composite lamp assembly according to claim 4, wherein a mast addition engages and extends beyond said attachment assembly in a direction substantially coinciding with a longitudinal axis of said central mast assembly.

6. A composite lamp assembly according to claim 5, wherein at least one composite arm assembly engages and extends outwardly from said mast addition, with said one composite arm assembly supporting at least one light fixture attached thereto.

7. A composite lamp assembly according to claim 1, wherein said wedging member is formed with a substantially talon-shaped configuration and each of said connecting sections is formed with a circumferentially extending outer surface.

8. A composite lamp assembly according to claim 1, wherein a pair of wedging members each engage radially inner surfaces of said adjacently positioned end portions with a separate tensioning screw extending between each wedging member and said ring-shaped clamping unit.

9. A composite lamp assembly according to claim 8, wherein each wedging member is formed with a substantially talon-shaped configuration.

10. A composite lamp according to claim 7, wherein each of said end portions of said adjacently positioned connecting sections includes a radially, inwardly extending flange formed with an inclined surface; and said talon-shaped wedging member includes a pair of inclined lobes for clamping against the inclined surface of said adjacently positioned end portions.

11. A composite lamp according to claim 10, wherein said inclined surface of said end portions are each inclined at a steeper angle than the lobes of said talon-shaped wedging member to ensure positive, clamping contact therebetween.

12. A composite lamp assembly according to claim 7, wherein said ring-shaped clamping unit includes an outer circumferential surface which is positioned in a plane including outer circumferential surfaces of said connecting sections to provide a continuous outer surface for said composite arm.

13. A composite lamp assembly according to claim 7, wherein said ring-shaped clamping unit includes a flat surface portion and each of said adjacently positioned connecting sections includes a similarly-shaped, flat surface portion for providing alignment with said clamping unit, while preventing rotation of said composite arm.

14. A composite lamp assembly according to claim 13, wherein said clamping unit and said connecting sections each have a plurality of confronting flat surface portions spaced at substantially 90 degrees intervals from one another about the circumference of said composite arm assembly.

15. A composite lamp assembly according to claim 8, wherein a plurality of ribs are positioned within said circumferentially extending end surfaces of said adjacently positioned end portions, said internal ribs form a grid wherein a pair of ribs extend on opposite sides of each talon-shaped wedging member to prevent rotation of said wedging member and to maintain said wedging member in proper position relative to said clamping unit.

16. A composite lamp assembly capable of providing artificial illumination, and comprising:

a central mast assembly and at least one composite arm assembly having a light fixture attached thereto, said central mast assembly including a circumferentially extending terminal portion adjacently positioned to an end portion of said composite arm assembly;

detachable clamping assembly including a ring-shaped clamping unit surrounding said adjacently positioned terminal portion and said end portion, at least one wedging member engaging radial inner surfaces of said terminal portion and said end portion and tensioning means extending between said clamping unit and said wedging member for drawing said clamping unit and said wedging member into clamping engagement with said terminal portion and said end portion to rigidly attach said composite arm assembly to said central mast assembly.

17. A composite lamp assembly according to claim 16, wherein said wedging member is formed with a talon-shaped configuration.

18. A composite lamp assembly according to claim 17, wherein a plurality of talon-shaped wedging members each engage radial inner surfaces of said adjacently positioned terminal portion and end configuration, with separate tensioning means extending between each talon-shaped wedging member and said ring-shaped clamping unit.

* * * * *